US009541349B2

(12) United States Patent
Benton et al.

(10) Patent No.: US 9,541,349 B2
(45) Date of Patent: Jan. 10, 2017

(54) KNIFE SHEATH

(71) Applicant: Palmetto Support Technologies LLC, Columbia, SC (US)

(72) Inventors: George A. Benton, Bemberg, SC (US); John Lowsky, Columbia, SC (US); Ezra Riber, Columbia, SC (US)

(73) Assignee: Palmetto Support Technologies, LLC, Columbia, SC (US)

( * ) Notice: Subject to any disclaimer, the term of this patent is extended or adjusted under 35 U.S.C. 154(b) by 48 days.

(21) Appl. No.: 14/666,851

(22) Filed: Mar. 24, 2015

(65) Prior Publication Data

US 2015/0267995 A1 Sep. 24, 2015

Related U.S. Application Data

(60) Provisional application No. 61/969,654, filed on Mar. 24, 2014, provisional application No. 62/075,232, filed on Nov. 4, 2014.

(51) Int. Cl.

| | |
|---|---|
| ***F41C 33/00*** | (2006.01) |
| ***F41C 33/04*** | (2006.01) |
| ***F41C 33/02*** | (2006.01) |
| *B26B 29/02* | (2006.01) |

(52) U.S. Cl.

CPC ..... *F41C 33/045* (2013.01); *F41C 33/0236* (2013.01); *B26B 29/025* (2013.01)

(58) Field of Classification Search

CPC . F41C 33/045; F41C 33/0236; F41C 33/0227; F41C 33/0209; F41C 33/0245; B26B 29/025; Y10S 224/911

USPC ..... 224/192, 193, 197, 198

See application file for complete search history.

(56) References Cited

U.S. PATENT DOCUMENTS

| | | | | |
|---|---|---|---|---|
| 626,472 A | | 6/1899 | White | |
| 946,132 A | | 1/1910 | Hull | |
| 1,511,916 A | | 10/1924 | Sipes | |
| 1,529,336 A | | 3/1925 | Wisniewski | |
| 2,098,139 A | | 11/1937 | Foley et al. | |
| 2,641,395 A | * | 6/1953 | Engle | F41C 33/0227 224/198 |
| 2,765,968 A | * | 10/1956 | Gaylord, Jr. | F41C 33/0209 224/198 |
| 2,805,507 A | | 9/1957 | Buquor | |

(Continued)

FOREIGN PATENT DOCUMENTS

| | | |
|---|---|---|
| CN | 2419569 Y | 2/2001 |
| CN | 2435717 Y | 6/2001 |

(Continued)

OTHER PUBLICATIONS

International Search Report and Written Opinion for Application No. PCT/US2015/022265 mailed Jun. 18, 2015.

*Primary Examiner* — Peter Helvey

(74) *Attorney, Agent, or Firm* — Merchant & Gould

(57) ABSTRACT

A sheath for carrying a knife in conjunction with a pistol holster. The sheath includes a first fastener and a second fastener. The sheath includes an internal volume defining a shape to receive the knife blade. The internal volume has a closed end and an open end. The knife sheath includes a pivot fastener to pivotally fasten the sheath to the pistol holster first fastener and an angle-adjustment fastener to fasten the sheath to the pistol holster second fastener and provide angle adjustment.

20 Claims, 8 Drawing Sheets

(56) References Cited

U.S. PATENT DOCUMENTS

| | | | | |
|---|---|---|---|---|
| 4,408,706 | A | 10/1983 | Hurley | |
| D275,509 | S | 9/1984 | Powell | |
| 5,018,653 | A * | 5/1991 | Shoemaker | F41C 33/0227 224/193 |
| 5,246,153 | A * | 9/1993 | Beletsky | A45F 3/14 224/192 |
| 5,421,497 | A * | 6/1995 | Gilmore | A45F 5/00 224/192 |
| 5,544,794 | A * | 8/1996 | Nichols | F41C 33/045 224/198 |
| 5,961,013 | A | 10/1999 | Collins | |
| 6,000,669 | A * | 12/1999 | Seward | E06C 7/14 248/210 |
| 6,189,751 | B1 * | 2/2001 | Tserng | F41C 33/0227 224/195 |
| 6,293,446 | B1 | 9/2001 | Nielsen | |
| 6,478,202 | B1 * | 11/2002 | Glock | F41C 33/043 224/198 |
| D530,386 | S | 10/2006 | Betts et al. | |
| 7,631,368 | B1 | 12/2009 | Samson | |
| 8,196,328 | B2 | 6/2012 | Simpkins | |
| 8,613,157 | B2 | 12/2013 | McCaffery | |
| 8,684,242 | B2 * | 4/2014 | Pomeroy | F41C 33/0209 224/191 |
| 9,086,254 | B1 * | 7/2015 | Plappert | F41C 33/041 |
| 2004/0217141 | A1 * | 11/2004 | Brooks | A45F 5/021 224/587 |
| 2009/0255970 | A1 * | 10/2009 | Votolato | A45F 5/00 224/660 |
| 2012/0175390 | A1 | 7/2012 | Rogers et al. | |
| 2013/0228601 | A1 | 9/2013 | Velarde | |
| 2014/0027479 | A1 * | 1/2014 | Hogue | F41C 33/0218 224/183 |

FOREIGN PATENT DOCUMENTS

| | | |
|---|---|---|
| CN | 2896197 Y | 5/2007 |
| GB | 229609 | 2/1925 |
| RU | 2 408 831 C1 | 1/2011 |

* cited by examiner

KNIFE SHEATH

CROSS-REFERENCE TO RELATED APPLICATIONS

This application claims priority to U.S. Patent Application No. 61/969,654 filed on Mar. 24, 2014 and U.S. Patent Application No. 62/075,232 filed on Nov. 4, 2014, both of which are entirely incorporated herein by reference.

TECHNICAL FIELD

The described technology relates generally to knives, and more particularly to knife sheaths.

BACKGROUND

In law enforcement, military, hunting and many first responder situations, concealed or hidden knives or other tools are often desired for numerous reasons. During the arrest of a violent suspect, an officer's personal safety may be jeopardized. For example, many officers encounter resistance when a suspect attempts to forcibly remove an officer's firearm and use it against the officer. According to FBI statistics gathered over the past 20 years, approximately 15%-20% of officers murdered in the line of duty, are killed with their own firearm. In order to prevent the threat of a suspect gaining control of their firearm, officers are trained to retain/trap the firearm in the holster using their "strong side hand" and defend against the attack using their "support side hand".

Similarly, when hunting, situations may arise where a hunter requires quick and ready access to his or her knife or other emergency object in order to maintain personal safety. Similarly, when skinning deer or other animals, having quick access to the skinning tool is desired. Additionally, first responders such as paramedics utilize apparatuses similar to holsters on their utility belts. Many times they have only seconds to respond to a given situation.

For these reasons, improvements in the technology for securing knives during use is desired.

SUMMARY

In one aspect, the present disclosure relates to a sheath for carrying a knife in conjunction with a pistol holster. The sheath includes a first fastener and a second fastener. The sheath includes an internal volume defining a shape to receive the knife blade. The internal volume has a closed end and an open end. The knife sheath includes a pivot fastener to pivotally fasten the sheath to the pistol holster first fastener and an angle-adjustment fastener to fasten the sheath to the pistol holster second fastener and provide angle adjustment.

In another aspect, the present disclosure relates to a sheath for carrying a knife in conjunction with a pistol holster. The pistol holster includes a pivot fastener and an angle-adjustment fastener. The sheath includes an internal volume defining a shape to receive the knife blade. The internal volume includes a tip end and an receiver end. The sheath includes a pivot fastener to pivotally fasten the sheath to the pistol holster pivot fastener. The sheath includes an angle-adjustment fastener to fasten the sheath to the pistol holster angle-adjustment fastener and provide angle adjustment thereto.

In a still further aspect, the present disclosure relates to a system for carrying a knife. The system includes a weapon holster with a pivot fastener and an angle-adjustment fastener. The system also includes a knife sheath with a pivot fastener and an angle-adjustment fastener. The knife sheath pivot fastener pivotally fastens to the weapon holster pivot fastener and the knife sheath angle-adjustment fastener adjustingly fastens to the weapon holster angle-adjustment fastener.

DESCRIPTION OF EXAMPLE EMBODIMENTS

Figure 1:
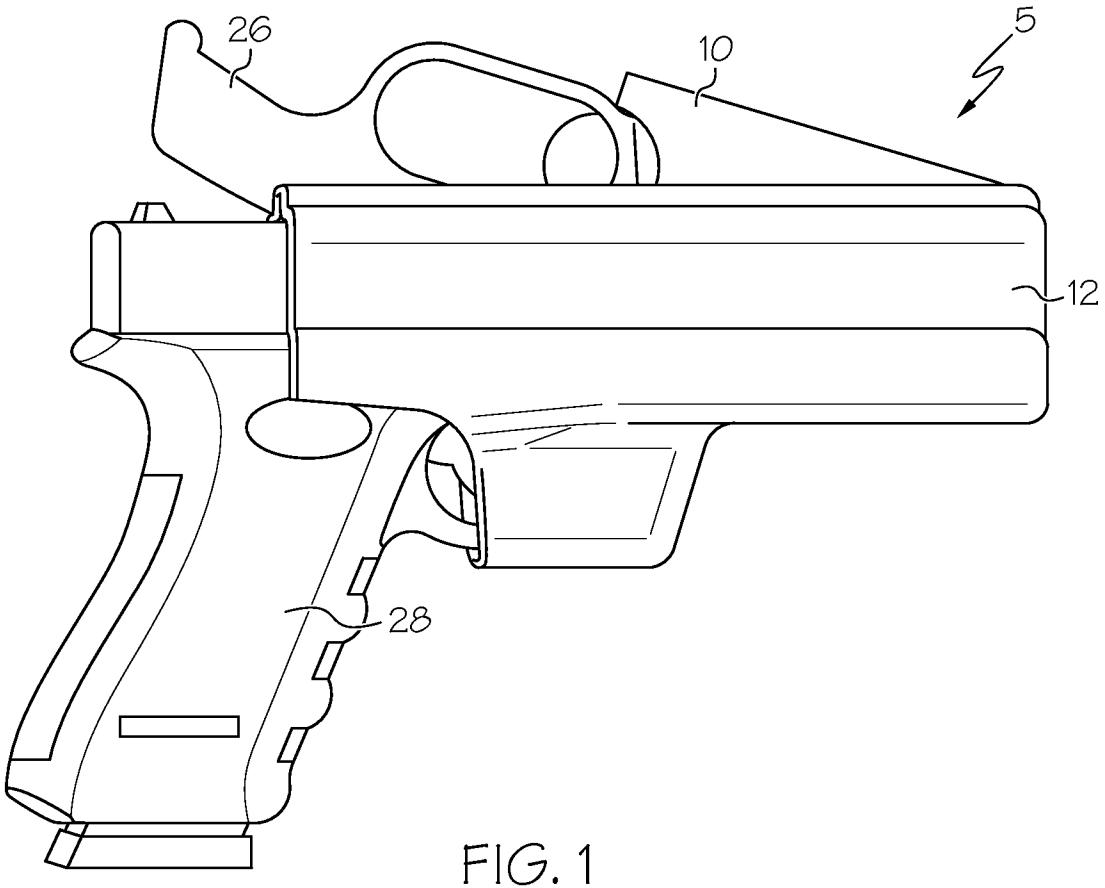
FIG. 1 is a side view of a knife sheath secured to the side of a pistol holster, as viewed from the outside-facing surface of the pistol holster, according to a first example embodiment of the present invention.
Figure 3:
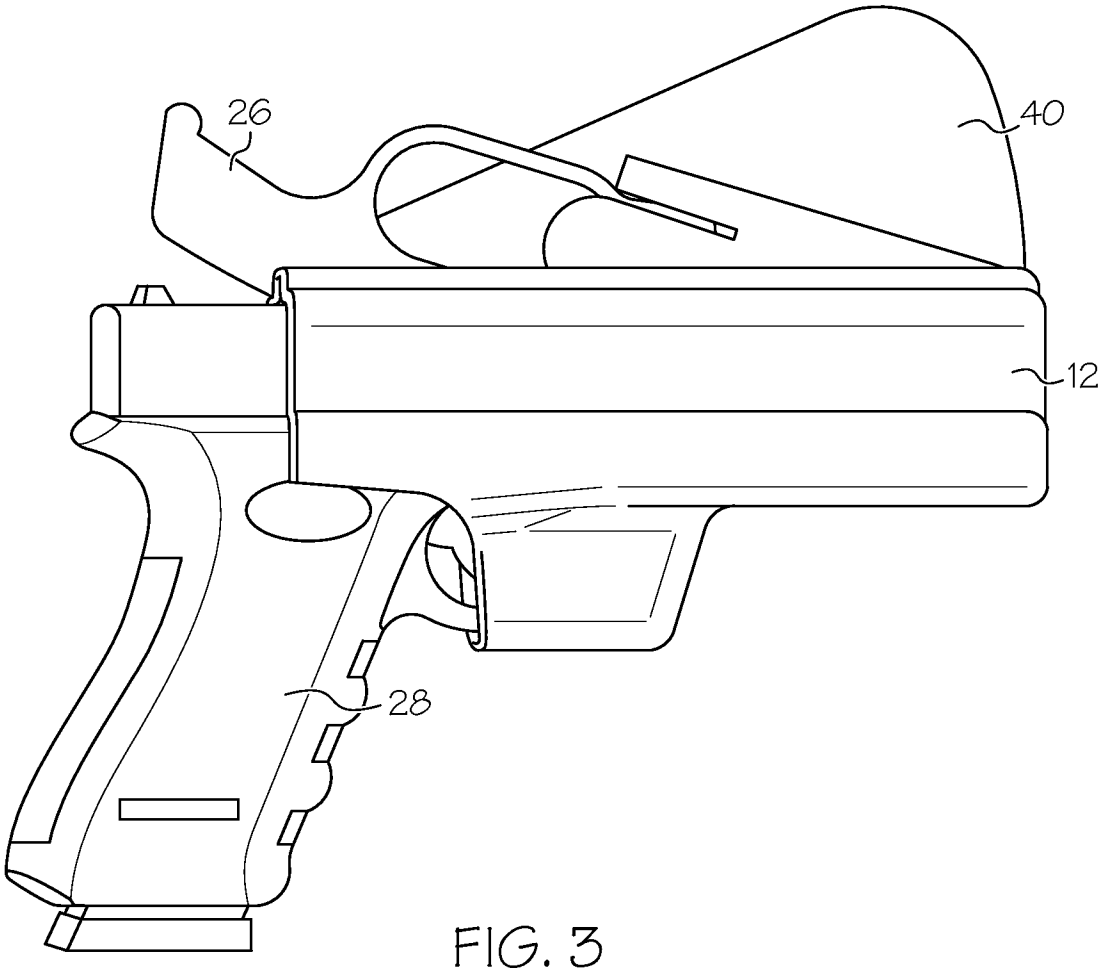
FIG. 3 is a side view of the knife sheath secured to the side of a pistol, as shown in FIG. 1, and also shown secured to a belt mount paddle.
Figure 4C:
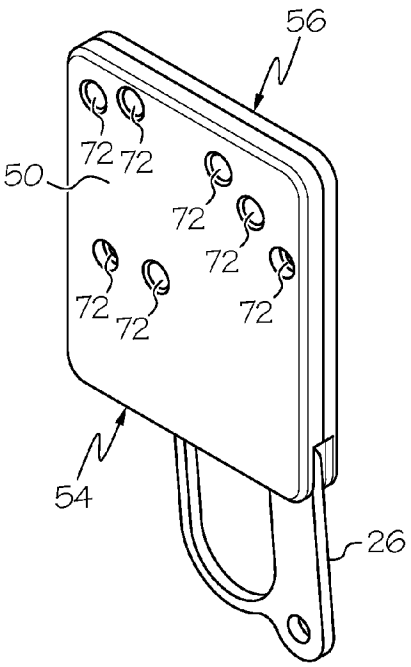
FIG. 4C is an isometric view of the knife sheath and knife shown in FIG. 4A.
Figure 4B:
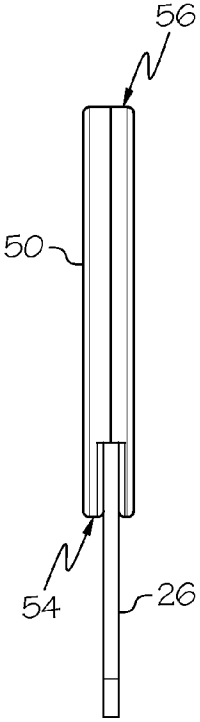
FIG. 4B is a front view of the knife sheath and knife shown in FIG. 4A.
Figure 4A:
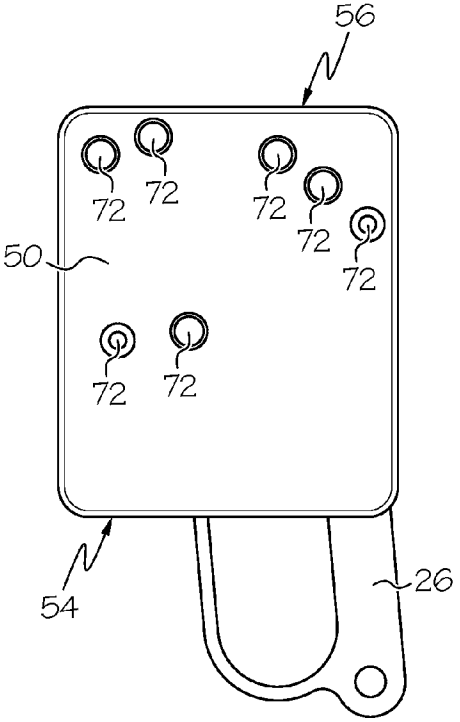
FIG. 4A is a side view of a knife sheath according to a second example embodiment of the present invention, shown securing a knife.
Figure 4D:
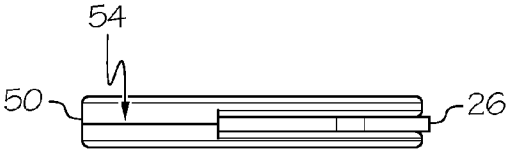
FIG. 4D is a bottom view of the knife sheath and knife shown in FIG. 4A.
Figure 5A:
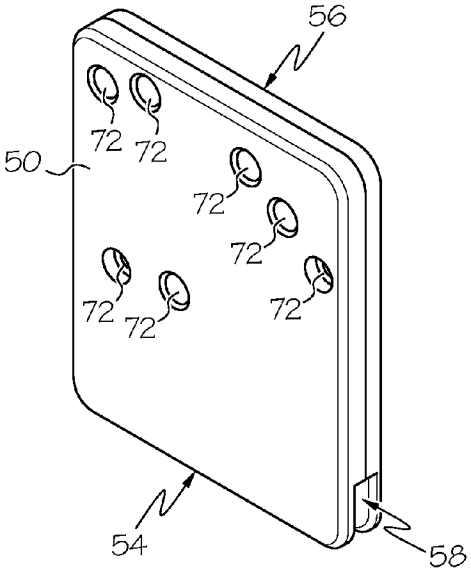
FIG. 5A is an isometric view of the knife sheath shown in FIGS. 4A-4D, shown without the knife.
Figure 5D:
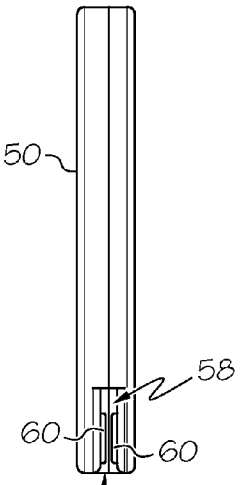
FIG. 5D is a front view of the knife sheath shown in FIGS. 4A-4D, shown without the knife.
Figure 5B:
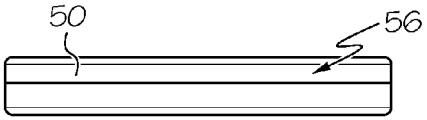
FIG. 5B is a top view of the knife sheath shown in FIGS. 4A-4D, shown without the knife.
Figure 5C:
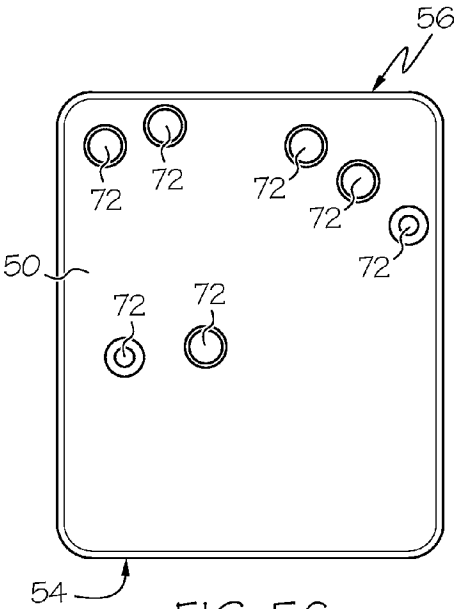
FIG. 5C is a side view of the knife sheath shown in FIGS. 4A-4D, shown without the knife.
Figure 5E:
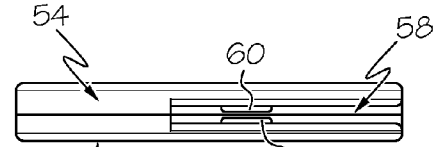
FIG. 5E is bottom view of the knife sheath shown in FIGS. 4A-4D, shown without the knife.
Figure 6A:
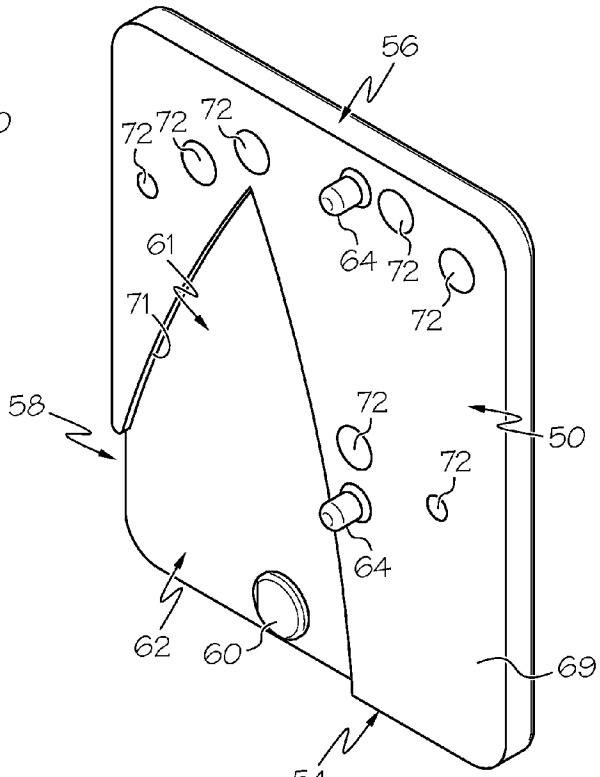
FIG. 6A is an isometric inside view of a first half of the knife sheath shown in FIGS. 5A-5E.
Figure 6C:
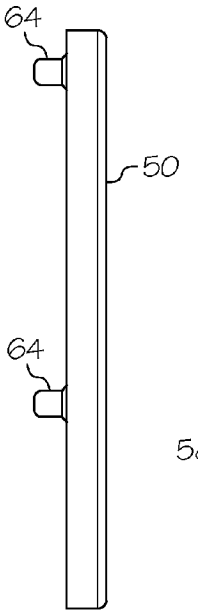
FIG. 6C is a front view of a first half of the knife sheath shown in FIGS. 5A-5E.
Figure 6B:
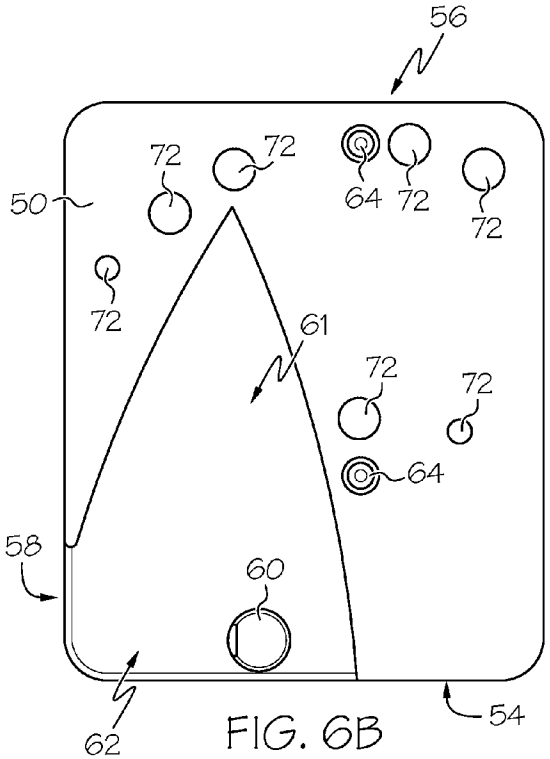
FIG. 6B is an inside side view of a first half of the knife sheath shown in FIGS. 5A-5E.
Figure 6D:
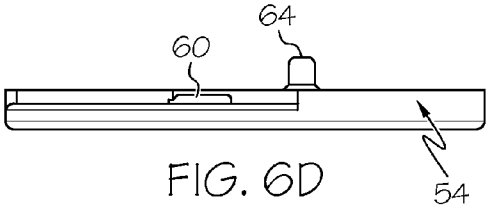
FIG. 6D is a bottom view of a first half of the knife sheath shown in FIGS. 5A-5E.
Figure 7A:
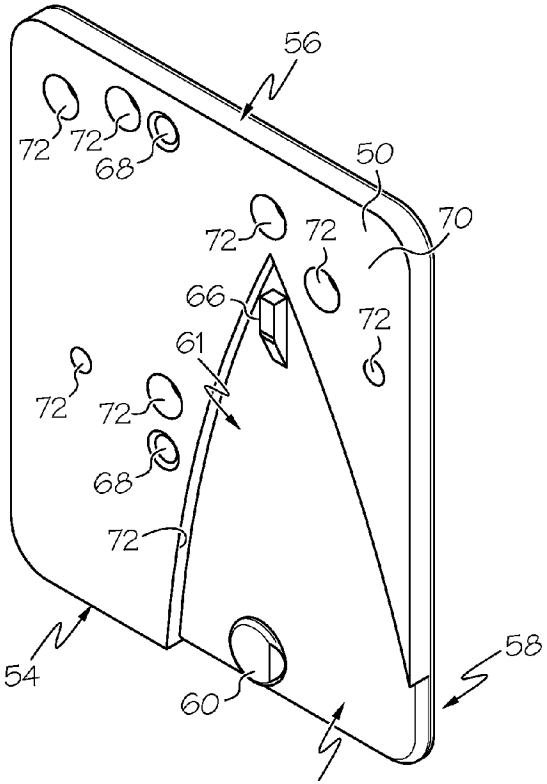
FIG. 7A is an isometric inside view of a second half of the knife sheath shown in FIGS. 5A-5E.
Figure 7C:
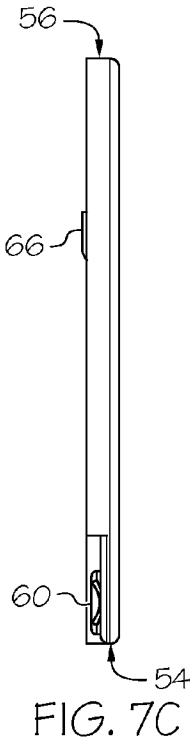
FIG. 7C is a front view of a second half of the knife sheath shown in FIGS. 5A-5E.
Figure 7B:
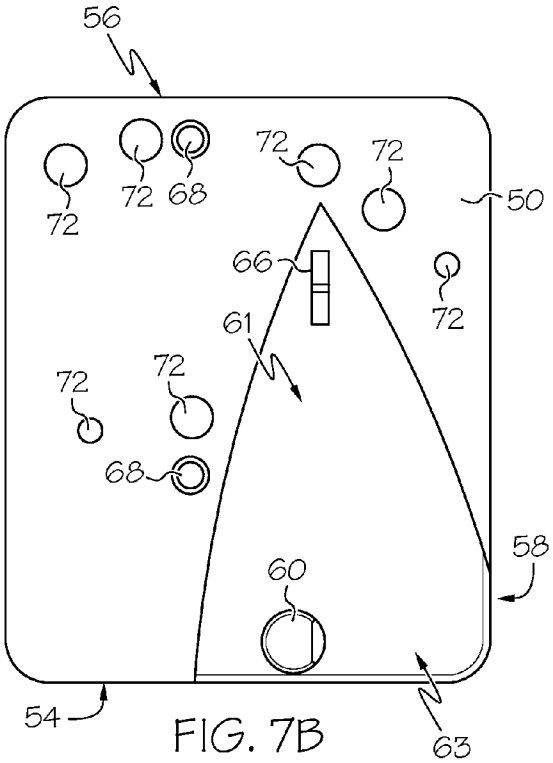
FIG. 7B is an inside side view of a second half of the knife sheath shown in FIGS. 5A-5E.
Figure 7D:
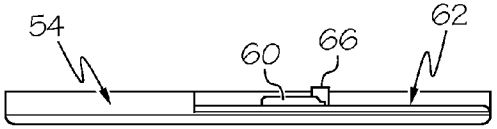
FIG. 7D is a bottom view of a second half of the knife sheath shown in FIGS. 5A-5E.

Referring to the above figures, FIG. 1 depicts a weapon carrying system 5. As depicted, the weapon carrying system 5 can include a gun holster 12 and sheath carrier 10. The weapon carrying system 5 can also include a mount 40 (FIG. 3), for example a belt clip or paddle, that secures the system to a user, for example onto pants or a belt. As depicted, the sheath carrier 10 is secured between the mount 40 and the gun holster 12, through securing means, for example fasteners such as bolts, screws and receivers, glue, or any securing means understood my one of ordinary skill in the art. Accordingly, the gun holster 12 can be used to secure and transport a gun 28, and the sheath carrier 10 can be used to secure and transport a knife 26, for example a knife with a handle 19 and a blade (not shown) that is tapered along both the sidewalls and the back and cutting edges, as would be understood by one of ordinary skill in the art. Alternatively, the knife sheath 10 can receive and secure a variety of tools, for example a flashlight, utility tool, hunting tool, magazine clip, handcuffs, or any device as contemplated and understood by one of ordinary skill in the art.

As depicted, the knife blade is narrowest between the sides and edges at the distal tip, and widest near the handle 19. The sheath carrier 10 can be removably or permanently secured to the gun holster 12 with at least one fastener, for example a bolt, glue, male and female receivers, snap, or as would be understood by one of ordinary skill in the art. As contemplated, the gun holster 12 is designed to receive and secure any commercially available pistol. As depicted, the sheath carrier 10 can be designed to receive and secure a knife with a blade and handle. The sheath carrier 10 preferably is constructed of a pair of parallel sidewalls defining a receiver volume therebetween, as would be understood by one of ordinary skill in the art. The internal receiver volume can be defined by closed sides at a forward nose (or tip) end 14 and along the top and bottom sides, with an open end at a receiver end 16. The sheath carrier 10 can have rigid and durable construction, for example with material such as plastic or metal. The sheath carrier 10 can be constructed of two separate sidewalls that are secured together, or can be constructed from a unitary monolithic structure through injection molding, heat/pressure molding or through a method understood by one of ordinary skill in the art.

Figure 2A:
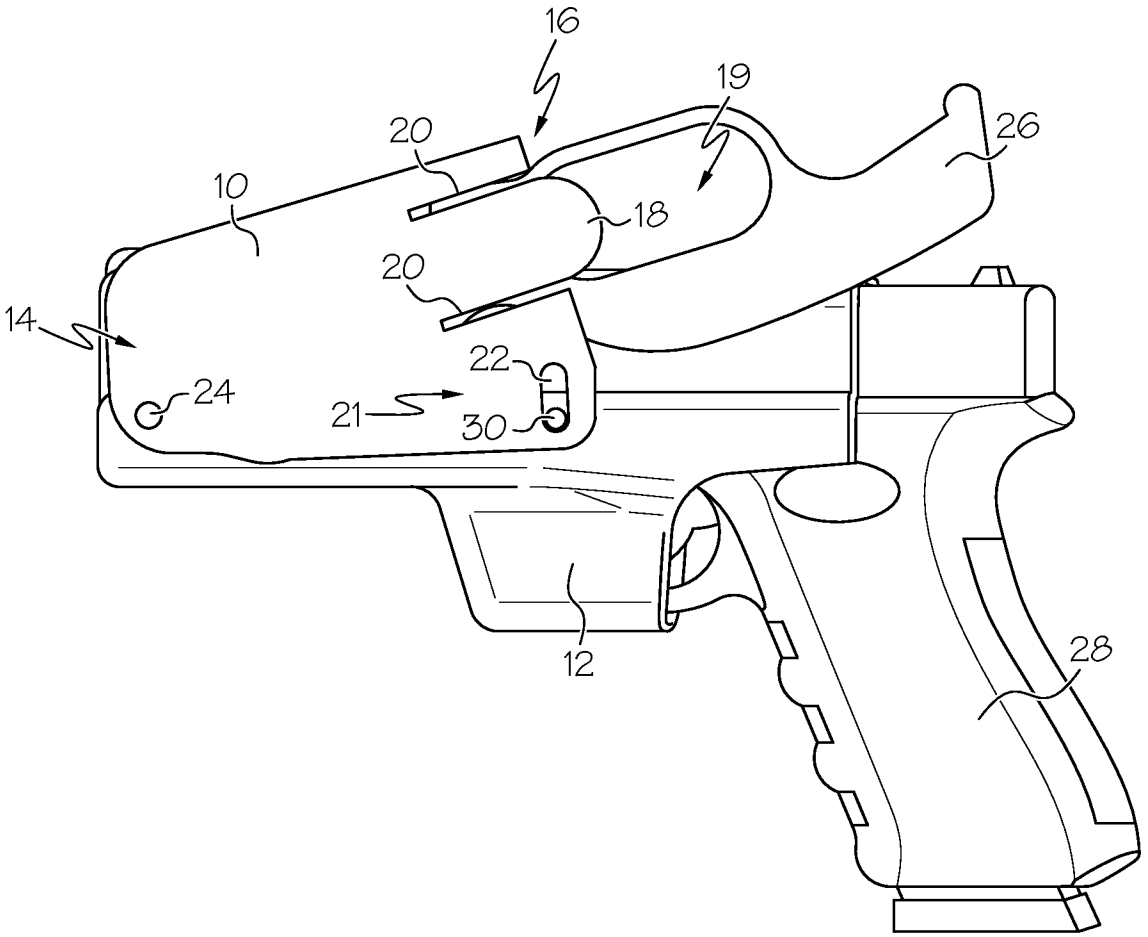
FIG. 2A is a side view of the knife sheath shown in FIG. 1 secured to a pistol holster, as viewed from the inside-facing surface of the pistol holster, and shown secured at a first angle with respect to the pistol holster.
Figure 2B:
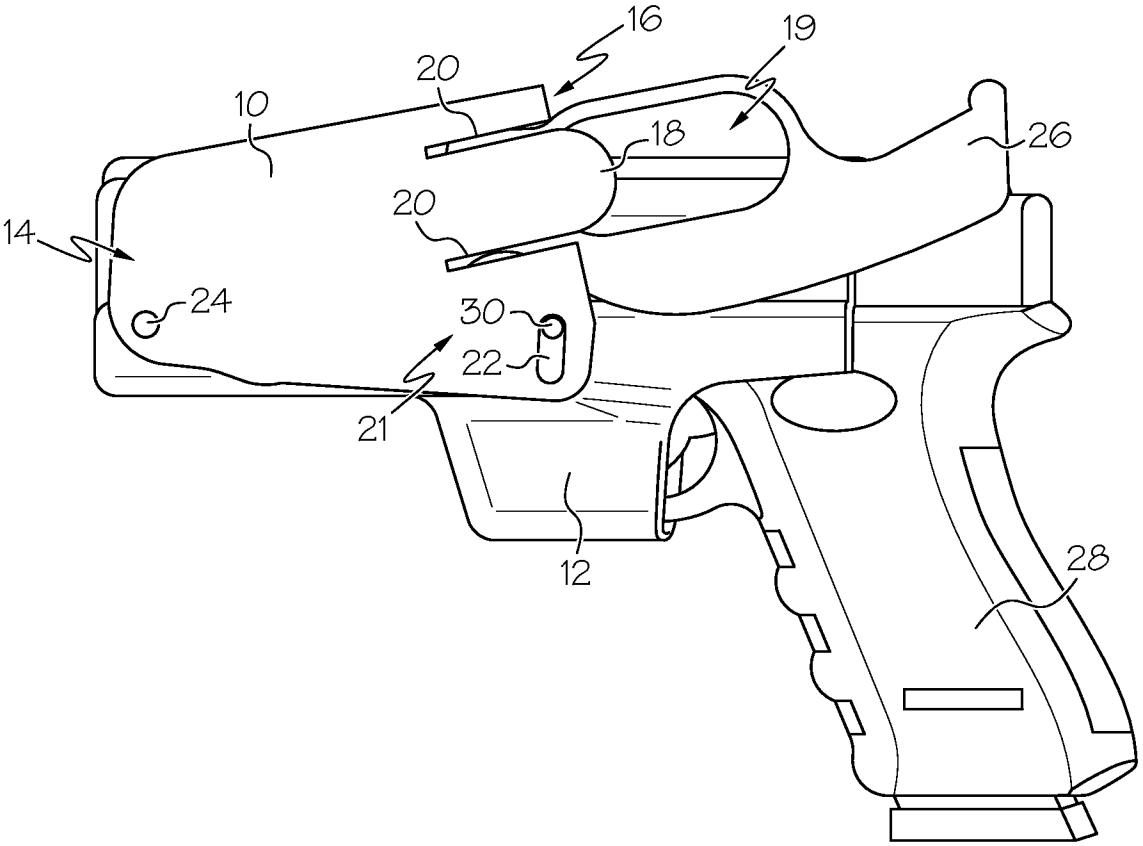
FIG. 2B is a side view of the knife sheath secured to a pistol holster, as shown in FIG. 2A, and shown secured at a second angle with respect to the pistol holster.

FIGS. 2A-2B depict the sheath carrier 10 secured to the gun holster 12 in alternative orientations. As depicted, the sheath carrier 10 fastens to the gun holster 12 at a pivot point 24, for example an aperture in the nose (or tip) end 14 of the knife sheath and a fastener protruding from the gun holster, in a method that would be understood by one of ordinary skill in the art. As depicted, the pivot point can be positioned proximal to the nose or forward end 14 of the sheath carrier 10. As depicted, the pivot point 14 can be aligned to fasten to the nose or forward end of the gun holster 12.

As depicted, the sheath carrier 10 can have a receiver end 16 opposite the nose tip end 14. The receiver end 16 can have an angle adjustment channel 22, for example an elongated aperture positioned vertically with respect to the longitudinal axis of the sheath carrier 10. The angle adjustment channel 22 receives a follower 30 that extends from the gun holster 12. The follower 30 can be a pin, bolt, or like structure, that extends outwardly through, and can adjust within, the angle adjustment channel 22. The follower 30 can alternatively be a screw that tightens into a receiver aperture in the gun holster (not shown), as understood by one of ordinary skill in the art. About the pivot point 24, the sheath carrier 10 can adjust its angle with respect to the gun holster 12, for example angled higher in FIG. 2A, and angled lower in FIG. 2B. The angle is reliant upon the position of the follower 30 within the adjustment channel 22, as depicted and understood by one of ordinary skill in the art.

The pivot point 24 and angle adjustment channel 22 also allow the sheath carrier 10 to be removable and reversible in direction with respect to the gun holster 12. For example, as depicted the sheath carrier 10 can be positioned such that the receiver end 16 of the sheath faces toward the rear of the gun holster 12 and gun. The sheath carrier 10 can be pivoted 180 degrees by removing the follower 30 from the adjustment channel 22 and pivoting the sheath carrier about the pivot point 24. Alternatively still (not shown) the sheath carrier 10 can be secured to the gun holster 12 such that the nose end 14 faces the rear of the gun 28, and the receiver end 16 is aligned with the nose end of the gun holster 12, in a way that would be understood by one of ordinary skill in the art. For example, the pivot point 24 could be fastened to the follower 30 and the angle adjustment channel 22 could be positioned around the fastener on the gun holster 12 that secures to the pivot point. As a result, the pivot point 24 functions to pivot in conjunction with the follower 30. Allowing the sheath carrier 10 to adjust its angle with respect to the gun holster 12 affords a user the ability to conceal the knife 26 behind the gun 28, or reveal a knife, as desired.

Once the user has adjusted the sheath carrier 10 to the desired position and angle, the follower 30 can be fixed or tightened to prevent unwanted rotation relative to the holster 12. For example, the follower 30 can be a screw that is tightened to pinch the sidewalls of the angle adjustment channel 22.

The compressive force exerted by the sheath carrier 10 on the knife 26 can be adjusted by the position of the follower within the angle adjustment channel 22. Moving the follower 30 in the adjustment channel 22 closer to the knife 26 (FIG. 2B) increases the compressive force between the sides of the sheath carrier 10. By contrast, moving the follower 30 away from the knife 26 (FIG. 2A) releases some compressive force applied by the sheath carrier 10 onto the knife 26.

As depicted in the FIGS. 2A-2B, there can be at least one compression member 18 positioned at the receiver end 16. Preferably, there is a pair of opposing stopper members 18. The compression members 18 can be physical structures, for example a button or ramp that protrudes inwardly from the inside surface of the knife sleeve 10. Preferably, the stopper members 18 protrude a distance such that in a relaxed state, the protrusion member extends within the handle portion 19 of the knife 26 to apply a resistive force against the knife and keep the knife within the sleeve 10. The stopper members 18 can be oriented parallel to walls of the sheath carrier 10. The multiple stopper members 18 can be orientated on opposing sides of the sleeve 10. The stopper members 18 can be comprised of a material such that the spring constant of the material allows the stopper members to displace when a separation force is applied and return to initial orientation when the separation force is removed.

As depicted, a plurality of flex structures 20, for example slots, can extend from the receiving end 16 to a position toward the nose end 14. These flex structures 20 can define the sides of the stopper members 18. The flex structures 20 can provide a degree of freedom by allowing the stopper members 18 to flex towards and away from the sleeve opening 58. Thus, when the knife 26 is being entered into the sheath carrier 10 through the receiver end 16, the insertion force, and tapered blade shape, of the knife forces the stopper members 18 to flex or displace away from each other while still maintaining an inward compressive force on the blade. When the knife has been inserted fully, the stopper members 18 will reflex inwardly back to their natural state within the handle 19.

FIGS. 4A-7D depict alternate second example knife sleeve 50 that functions similarly to the sheath carrier 10 structure described above, for example to be secured in a variety of pivotal angles between and with respect to the gun holster 12 and the mount 40, and to receive an object, for example the knife 26. Similarly to the sheath carrier 10 described above, the sheath carrier 50 has a forward nose tip end 56 and a receiver end 54. Similarly to the sheath carrier 10 described above, the knife sleeve 50 has two parallel components. As depicted, the two parallel components share common dimensions and features. The sheath carrier 50 can alternatively be formed of a unitary monolithic structure, similarly to the sheath carrier 10 described above.

Similarly to the sheath carrier 10 described above, the depicted knife sleeve 50 can be secured to the gun holster 12 and mount 40 at a variety of angles and orientations, and can be repositioned to change such angles and orientations. To secure and change such angles and orientations, the sheath carrier 50 includes a plurality of positionally specific receivers 72, for example apertures, spaced and positioned on the sheath carrier to receive the fasteners from the gun holster 12 and mount 40. As depicted, the positionally specific receivers 72 can be apertures that extend through each parallel component at commonly opposing positions. When the sheath carrier 50 is secured to the gun holster 12, a variety of combinations of a pair of the receivers 72 can perform the described function of pivot point and angle-adjustment mechanism. For example a single receiver 72 can be secured to the holster 12, and then a variety of receivers can be alternatively individually secured to the holster to pivot the sleeve and change the angle, as would be understood by one of ordinary skill in the art.

The depicted sheath carrier 50 provides access to an internal receiver volume 61, similarly to the sheath carrier 10 described above, through an opening at the receiver end 54 and an opening 58 extending a partial distance along an edge away from the receiver end. Similarly to the sheath carrier 10 above, the internal receiver volume 61 of the sheath carrier 50 is defined by recessed surfaces 62, 63 positioned on the inner surfaces 69, 70 of the sheath, with common dimensions and positions opposing each other on the internal surfaces of each parallel component. As depicted, the shape of the internal receiver volume 61 is consistent with the shape of the blade of a knife, such that sidewalls 71, 72 of the internal cavity 61 converge to a point. In one example embodiment, a receiver 72 positioned proximal to the tip end of the internal receiver volume 61 can function as the pivot point, and a plurality of receivers outside of the internal receiver volume 61 can function as the angle adjustment mechanism.

Similarly to the sheath carrier 10 above, the sheath carrier 50 includes a pair of opposing stopper members 60 extending toward each other from the internal recessed surfaces 62, 63. Alternatively, a single stopper component can extend from one of the internal recessed surfaces 62, 63 and provide a similar locking function. Similarly to the sheath carrier 10 described above, the stopper members 60 can be located near the receiver opening 58 to align with the internal aperture of the handle of the knife 26 in order to prevent the knife from easily dislodging from the sheath during use. Similarly to the sheath carrier 10, the stopper members 60 can be button structures or ramps to allow the tapered knife blade to slide between them during insertion and removal from the internal volume 61. Similarly to the sheath carrier 10 described above, the recessed surfaces 62, 63 provide flexing motion when the knife 26 is inserted into and taken out of the sheath. For example, because the recessed surfaces 62,63 have less material than the rest of the component surfaces, the application of ourtward force by the knife 26 onto the stoppers 60 causes the recessed surfaces to flex outwardly.

FIGS. 6A-7D, in particular, depict the sheath carrier 50 disassembled to show two component halves in isolation. Similarly to the sheath carrier 10 described above, a pair of male fasteners 64, for example protruding knobs or posts, extend from an inner surface wall 69, one male protrusion positioned near the nose end 56 and the other positioned near the receiver end 54. It is contemplated that the fasteners 64 can be positioned at alternative locations that function similarly as understood by one of ordinary skill in the art. The fasteners 64 are orientated to engage female receivers 68 in the opposing component half shown specifically in FIGS. 7A-7D.

FIGS. 7A-7D in particular also depict a knife tip engager 66 positioned at the narrowed tip end of the recessed surface 63. The knife tip engager 66 can be a protruding male structure with an angled rear-facing ramp surface that engages the knife tip when the knife 26 is inserted into the receiver volume 61. As depicted, the knife tip engager 66 can protrude away from the recessed surface 63 a distance further than the stopper members 60, for example the knife tip member can extend the entire distance between the recessed surfaces 62, 63. The knife tip engager 66 provides an additional measure to minimize movement of the knife blade 26 when the knife has been entered into the knife sheath 50.

Alternatively, the knife sheath and the gun holster can be a single unitary monolithic unit, formed for example, through injection molding. In such an alternative embodiment, it is contemplated that the knife sheath and gun holster to not pivot or change angle with respect to each other. It is understood that in such an alternative embodiment, the position of the knife sheath and gun holster is fixed.

We claim:

1. A sheath for carrying a knife in conjunction with a pistol holster comprising a first fastener and a second fastener, the sheath comprising:

an internal volume defining a shape to receive the knife blade, the internal volume comprising a closed end and an open end;

a pivot fastener to pivotally fasten the sheath to the pistol holster first fastener; and an angle-adjustment fastener to fasten the sheath to the pistol holster second fastener and provide angle adjustment.

2. The sheath of claim 1, wherein the pivot fastener comprises a receiver to receive the pistol holster first fastener.

3. The sheath of claim 1, wherein the pivot fastener is positioned proximal to the internal volume closed end.

4. The sheath of claim 1, wherein the angle-adjustment fastener is positioned proximal to the internal volume open end.

5. The sheath of claim 4, wherein the angle-adjustment fastener is an elongated slot receiver to slotably receive the pistol holster second fastener.

6. The sheath of claim 4, wherein the angle-adjustment fastener comprises a plurality of receivers positioned at different locations with respect to the pivot fastener.

7. The sheath of claim 1, wherein the internal volume is defined by a pair of opposing recessed surfaces extending between the closed and the open end.

8. The sheath of claim 1, further comprising a stopper to releasably lock the knife within the internal volume.

9. The sheath of claim 8, wherein the stopper comprises a pair of opposing protrusions extending toward each other near the open end.

10. The sheath of claim 8, wherein the sheath open end reflexively flexes when the knife is inserted into the internal volume and contacts the stopper.

11. A sheath for carrying a knife in conjunction with a pistol holster comprising a pivot fastener and an angle-adjustment fastener, the sheath comprising:

an internal volume defining a shape to receive the knife blade, the internal volume comprising a tip end and an receiver end;

a pivot fastener to pivotally fasten the sheath to the pistol holster pivot fastener; and an angle-adjustment fastener to fasten the sheath to the pistol holster angle-adjustment fastener and provide angle adjustment thereto.

12. The sheath of claim 11, wherein the sheath pivot fastener is positioned proximal to the internal volume tip end.

13. The sheath of claim 11, wherein the sheath angle-adjustment fastener is positioned proximal to the internal volume receiver end.

14. The sheath of claim 13, wherein the sheath angle-adjustment fastener is an elongated slot receiver to slotably receive the pistol holster angle-adjustment fastener.

15. The sheath of claim 13, wherein the sheath angle-adjustment fastener comprises a plurality of receivers positioned at different locations with respect to the sheath pivot fastener.

16. A system for carrying a knife, the system comprising:

a weapon holster comprising a pivot fastener and an angle-adjustment fastener; and a knife sheath comprising a pivot fastener and an angle-adjustment fastener, the knife sheath pivot fastener pivotally fastens to the weapon holster pivot fastener and the knife sheath angle-adjustment fastener adjustingly fastens to the weapon holster angle-adjustment fastener.

17. The system of claim 16, wherein the knife sheath further comprises an internal volume defining a shape to receive the knife blade, the internal volume comprising a closed end and an open end.

18. The system of claim 17, wherein the knife sheath pivot fastener is positioned proximal to the internal volume closed end and the knife sheath pivot fastener is positioned proximal to the internal volume open end.

19. The system of claim 16, wherein the knife sheath angle-adjustment fastener is an elongated slot receiver to slotably receive the weapon holster second fastener.

20. The system of claim 16, wherein the knife-sheath angle-adjustment fastener comprises a plurality of receivers positioned at different locations with respect to the knife sheath pivot fastener.

* * * * *